US006345556B1

(12) United States Patent
Lin

(10) Patent No.: US 6,345,556 B1
(45) Date of Patent: Feb. 12, 2002

(54) SCREWDRIVER HANDLE STRUCTURE HAVING SOFT CUSHION

(76) Inventor: Jack Lin, 103, Nan-Gang 3rd Rd., Nan-Gang, Industrial Zone, Nan-Tou (TW)

( * ) Notice: Subject to any disclaimer, the term of this patent is extended or adjusted under 35 U.S.C. 154(b) by 0 days.

(21) Appl. No.: 09/710,202

(22) Filed: Nov. 17, 2000

(51) Int. Cl.[7] ..... B25G 1/01; B25B 23/16
(52) U.S. Cl. ..... 81/177.1; 81/489; 81/900
(58) Field of Search ..... 81/489, 900, 177.1; 16/430, 436, 421, DIG. 12; 30/340

(56) References Cited

U.S. PATENT DOCUMENTS 626,867 A * 6/1899 Maas ..... 81/489
4,721,021 A * 1/1988 Kusznir ..... 81/489 X
4,787,276 A * 11/1988 Condon ..... 81/177.1
5,390,572 A * 2/1995 Gakhar et al. ..... 81/436
6,199,460 B1 * 3/2001 Lo ..... 81/489

* cited by examiner

*Primary Examiner*—D. S. Meislin
(74) *Attorney, Agent, or Firm*—Charles E. Baxley

(57) ABSTRACT

A screwdriver handle structure having a soft cushion includes a handle including a solid body having a periphery defining a plurality of recesses and a soft coating layer coated in the plurality of recesses of the solid body, a shank having a distal end secured in the solid body of the handle, and a cushion fused in the solid body of the handle and rested on a top of the distal end of the shank.

7 Claims, 5 Drawing Sheets

SCREWDRIVER HANDLE STRUCTURE HAVING SOFT CUSHION

BACKGROUND OF THE INVENTION

1. Field of the Invention

The present invention relates to a screwdriver handle structure, and more particularly to a screwdriver handle structure having a soft cushion.

2. Description of the Related Art

A conventional screwdriver 1 in accordance with the prior art shown in FIG. 1 comprises a handle 12 coated with a soft layer 14, a metallic shank 11 having a rear end secured in the handle 12, and a nut 111 mounted in the handle 12 and secured on the rear end of the shank 11. However, air bubbles 13 are easily generated in the handle 12 and located adjacent to the rear end of the shank 11 during the injection molding process, thereby decreasing the strength of the handle 12 so that the handle 12 cannot endure a large impact. Accordingly, when the shank 11 is subjected to a large impact, the handle 12 is easily broken, thereby injuring the user.

SUMMARY OF THE INVENTION

The present invention has arisen to mitigate and/or obviate the disadvantage of the conventional screwdriver.

In accordance with one aspect of the present invention, there is provided a screwdriver handle structure having a soft cushion comprising:

- a handle including a solid body having a periphery defining a plurality of recesses, and a soft coating layer coated in the plurality of recesses of the solid body;
- a shank having a distal end secured in the solid body of the handle; and
- a cushion fused in the solid body of the handle and rested on a top of the distal end of the shank.

In accordance with another feature of the present invention, the cushion has a length of at least 5 mm.

In accordance with a further feature of the present invention, the cushion and the soft coating layer of the handle are made of the same material.

In accordance with a further feature of the present invention, the solid body of the handle defines an axial shank receiving hole for receiving the shank, and a cushion receiving hole communicating with the shank receiving hole for receiving the cushion.

In accordance with a further feature of the present invention, the solid body of the handle defines an injection hole connected between the recess and the cushion receiving hole.

In accordance with a further feature of the present invention, the cushion is connected to the soft coating layer of the handle through the injection hole. Alternatively, the cushion is integrally formed with the soft coating layer of the handle through the injection hole.

Further benefits and advantages of the present invention will become apparent after a careful reading of the detailed description with appropriate reference to the accompanying drawings.

DETAILED DESCRIPTION OF THE INVENTION

Figure 1:
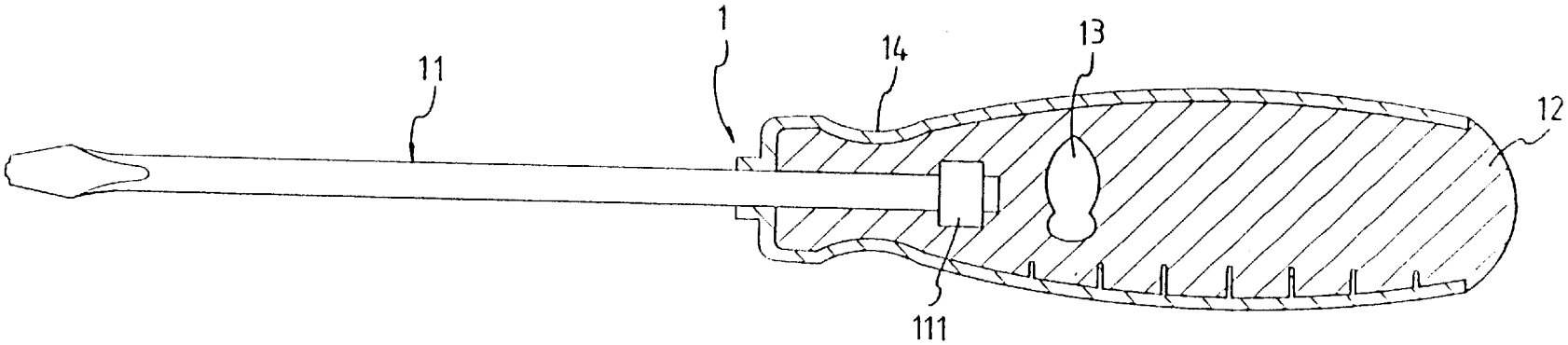
FIG. 1 PRIOR ART
FIG. 1 is a side plan cross-sectional view of a conventional screwdriver in accordance with the prior art.
Figure 2:
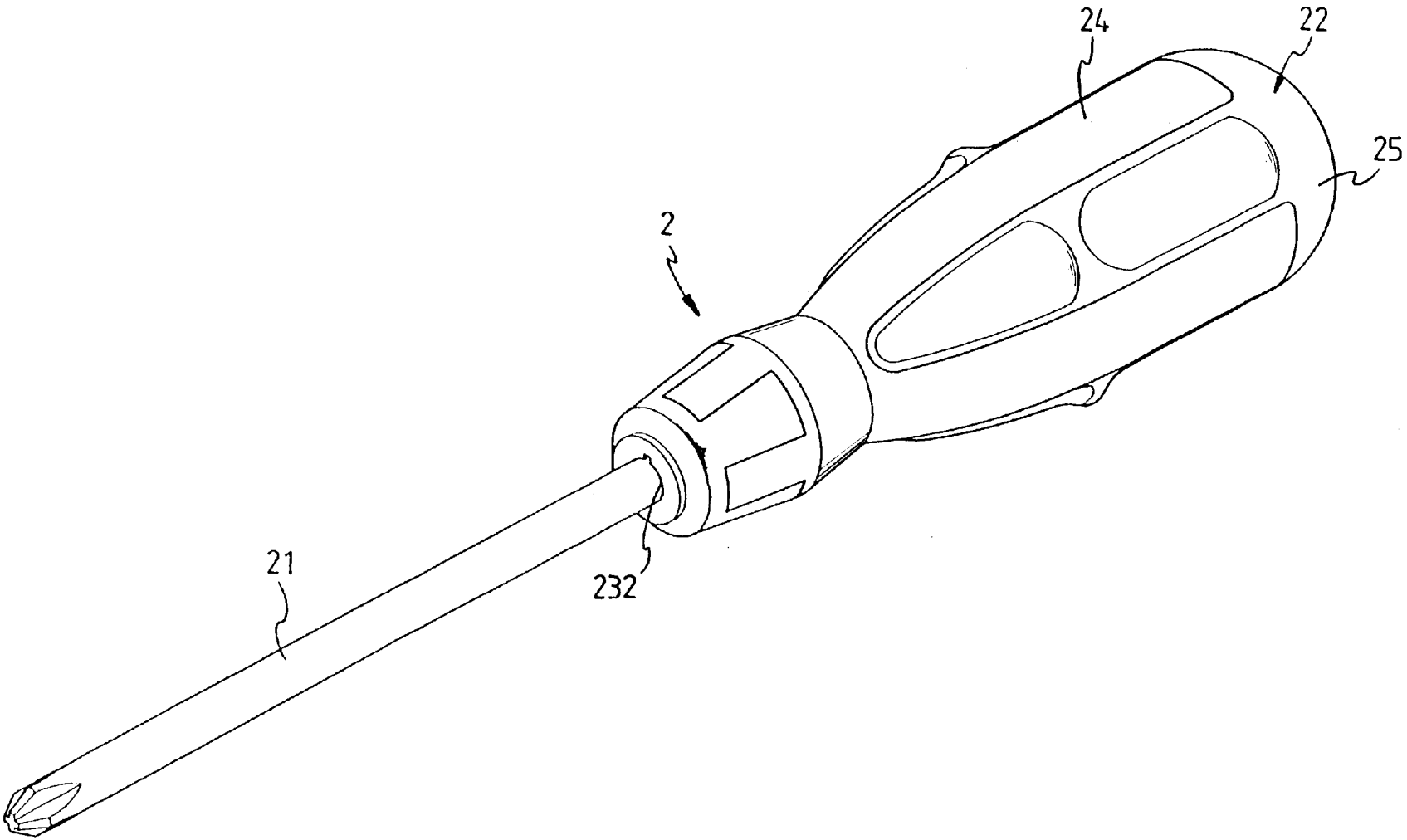
FIG. 2 is a perspective view of a screwdriver handle structure in accordance with the present invention.
Figure 3:
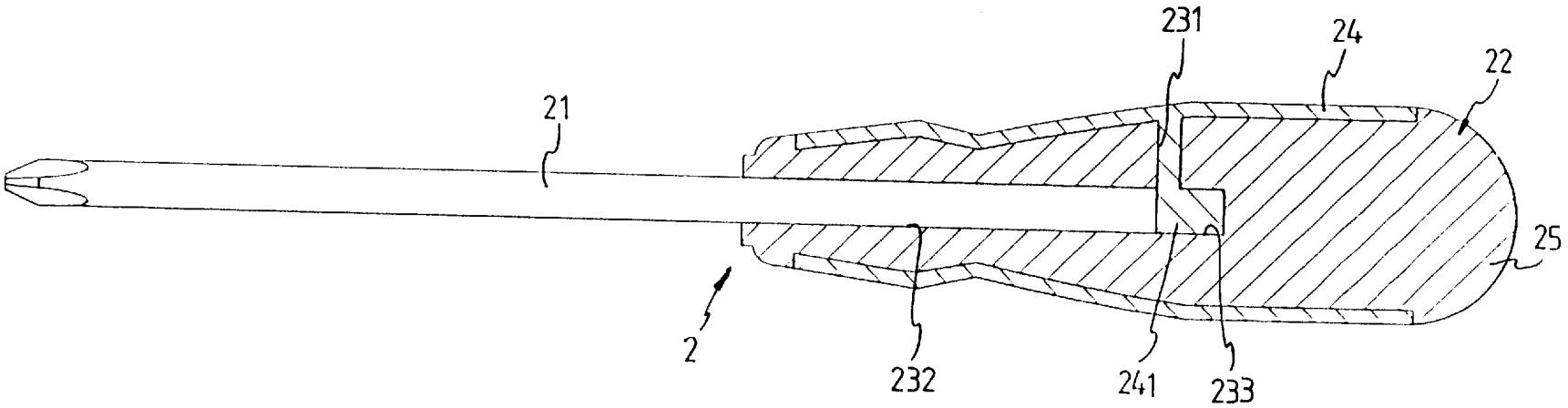
FIG. 3 is a side plan cross-sectional view of the screwdriver handle structure as shown in FIG. 2.

Referring to FIGS. 2–5, a screwdriver handle structure 2 having a soft cushion in accordance with the present invention comprises a handle 22 including a solid body 25 having a periphery defining a plurality of recesses 23, and a soft coating layer 24 coated in the plurality of recesses 23 of the solid body 25, a shank 21 having a distal end secured in the solid body 25 of the handle 22, and a cushion 241 fused in the solid body 25 of the handle 22 and rested on a top of the distal end of the shank 21.

The solid body 25 of the handle 22 defines an axial shank receiving hole 232 for receiving the shank 21, and a cushion receiving hole 233 communicating with the shank receiving hole 232 for receiving the cushion 241. The solid body 25 of the handle 22 also defines an injection hole 231 connected between the recess 23 and the cushion receiving hole 233.

The cushion 241 is connected to the soft coating layer 24 of the handle 22 through the injection hole 231. Alternatively, the cushion 241 is integrally formed with the soft coating layer 24 of the handle 22 through the injection hole 231.

Figure 4:
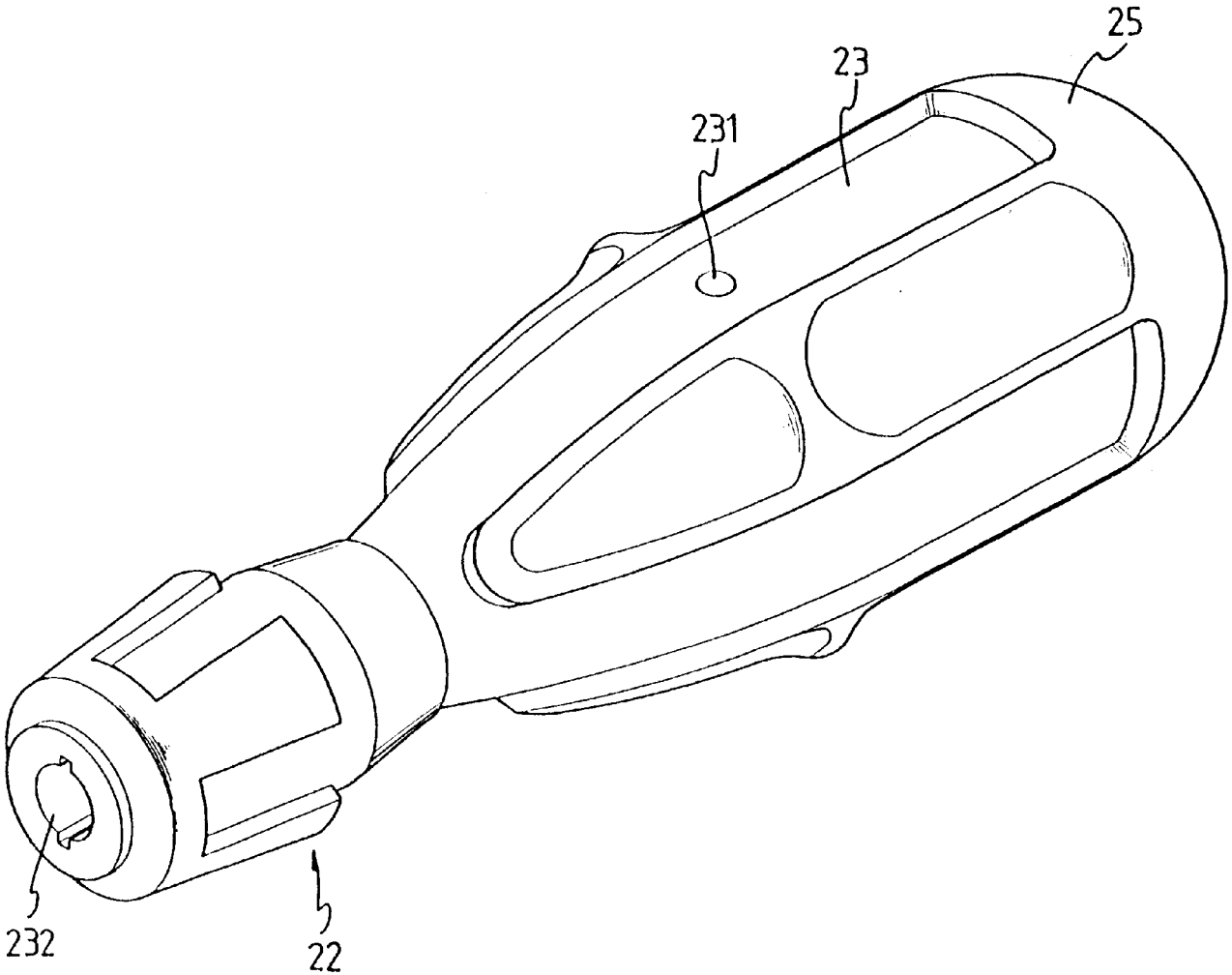
FIG. 4 is a perspective view of a handle of the screwdriver handle structure in accordance with the present invention.
Figure 5:
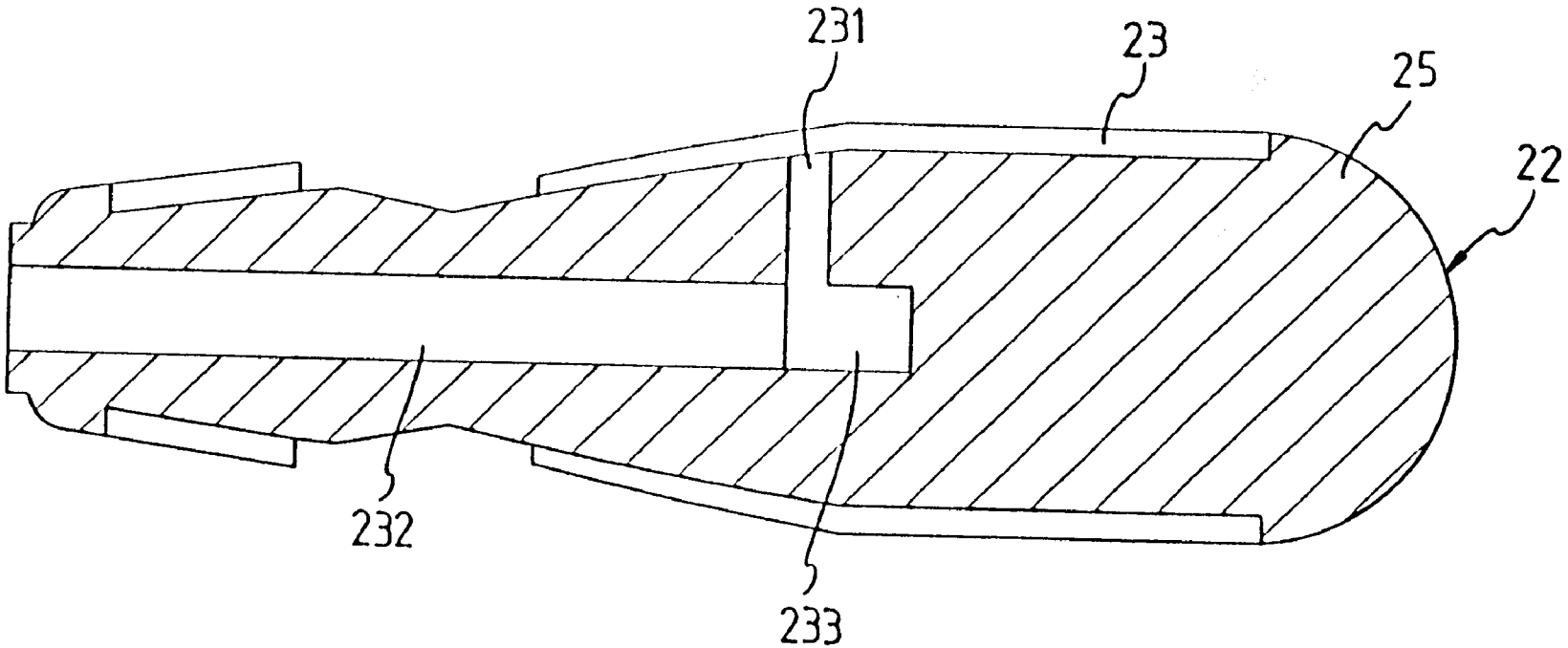
FIG. 5 is a side plan cross-sectional view of the handle as shown in FIG. 4.

In practice, as shown in FIGS. 4 and 5, during the first injection molding process, the solid body 25 of the handle 22 is formed with an axial shank receiving hole 232 for receiving the shank 21, a cushion receiving hole 233 communicating with the shank receiving hole 232 for receiving the cushion 241, and an injection hole 231 connected between the recess 23 and the cushion receiving hole 233.

The solid body 25 of the handle 22 is made of PVC material which is rigid with a rigidity ranged between SHORE D 65 and 75, and cannot endure large impact.

Air bubbles are not easily generated in the solid body 25 of the handle 22 by provision of the injection hole 231. If air bubbles are generated in the solid body 25 of the handle 22, the air bubbles are retained in the cushion receiving hole 233, and are spaced apart from the shank receiving hole 232.

The solid body 25 of the handle 22 removed from the first injection molding process are placed into a secondary mold during the second injection molding process while the shank 21 is automatically fitted into the shank receiving hole 232 of the solid body 25 of the handle 22 by a mechanic arm. The heated fused soft plastic material is injected to flow into the recess 23 of the solid body 25, and then flows into the cushion receiving hole 233 through the injection hole 231 so that the soft plastic material is filled with the recess 23, the injection hole 231 and the cushion receiving hole 233, thereby forming the soft coating layer 24 in the recess 23 and simultaneously forming the cushion 241 in the cushion receiving hole 233, wherein the cushion 241 is rested on the shank 21. In such a manner, the cushion 241 is integrally formed with the soft coating layer 24 of the handle 22 through the injection hole 231 so that the air bubbles cannot be produced in the cushion receiving hole 233.

The cushion 241 and the soft coating layer 24 of the handle 22 are made of the same material. Preferably, the cushion 241 and the soft coating layer 24 of the handle 22 are made of soft thermoplastic elastic material with a rigidity ranged between SHORE A 35 and 75. Preferably, the cushion 241 has a length of at least 5 mm.

Accordingly, the cushion 241 is rested on the rear end of the shank 21 so that when the shank 21 is subjected to a large impact, the cushion 241 can be used to absorb the force and energy of the impact, thereby preventing the shank 21 from penetrating through the solid body 25 of the handle 22, and thereby preventing the user from being injured.

It should be clear to those skilled in the art that further embodiments may be made without departing from the scope of the present invention.

What is claimed is:

1. A screwdriver handle structure having a soft cushion comprising:

a handle (22) including a solid body (25) having a periphery defining a plurality of recesses (23), and a soft coating layer (24) coated in said plurality of recesses (23) of said solid body (25);

a shank (21) having a distal end secured in said solid body (25) of said handle (22); and a cushion (241) fused in said solid body (25) of said handle (22) and rested on a top of said distal end of said shank (21).

2. The screwdriver handle structure having a soft cushion in accordance with claim 1, wherein said cushion (241) has a length of at least 5 mm.

3. The screwdriver handle structure having a soft cushion in accordance with claim 1, wherein said cushion (241) and said soft coating layer (24) of said handle (22) are made of the same material.

4. The screwdriver handle structure having a soft cushion in accordance with claim 1, wherein said solid body (25) of said handle (22) defines an axial shank receiving hole (232) for receiving said shank (21), and a cushion receiving hole (233) communicating with said shank receiving hole (232) for receiving said cushion (241).

5. The screwdriver handle structure having a soft cushion in accordance with claim 4, wherein said solid body (25) of said handle (22) defines an injection hole (231) connected between said recess (23) and said cushion receiving hole (233).

6. The screwdriver handle structure having a soft cushion in accordance with claim 5, wherein said cushion (241) is connected to said soft coating layer (24) of said handle (22) through said injection hole (231).

7. The screwdriver handle structure having a soft cushion in accordance with claim 5, wherein said cushion (241) is integrally formed with said soft coating layer (24) of said handle (22) through said injection hole (231).

* * * * *